US007261206B2

(12) United States Patent
Rulifson

(10) Patent No.: US 7,261,206 B2
(45) Date of Patent: Aug. 28, 2007

(54) MEDICATION DOSAGE REGIMEN COMMUNICATION DEVICE

(76) Inventor: Brian Charles Rulifson, 1140 Laurel St., Apt. 3, Menlo Park, CA (US) 94025

( * ) Notice: Subject to any disclaimer, the term of this patent is extended or adjusted under 35 U.S.C. 154(b) by 248 days.

(21) Appl. No.: 11/048,196

(22) Filed: Feb. 1, 2005

(65) Prior Publication Data

US 2006/0169621 A1 Aug. 3, 2006

(51) Int. Cl.

| | |
|---|---|
| ***B65D 83/04*** | (2006.01) |
| ***B65D 6/28*** | (2006.01) |
| ***B65D 85/42*** | (2006.01) |
| ***A47G 19/00*** | (2006.01) |

(52) U.S. Cl. ..... 206/538; 206/470; 206/534; 220/4.27; 220/23.83

(58) Field of Classification Search ..... 206/531–532, 206/534, 538–539, 461, 470–471; 220/4.21–4.27, 220/23.2–23.8, 23.83
See application file for complete search history.

(56) References Cited

U.S. PATENT DOCUMENTS

| | | | | |
|---|---|---|---|---|
| 1,717,060 | A | 6/1929 | Mottayaw | |
| 1,844,189 | A | 2/1932 | Stuart | |
| 2,115,021 | A | 4/1938 | Joffee | |
| 3,003,273 | A | 10/1961 | Tapper | |
| 3,225,913 | A | 12/1965 | Lee | |
| 3,527,190 | A * | 9/1970 | Huck | 206/534 |
| 3,603,453 | A * | 9/1971 | Serrell et al. | 206/534 |
| 3,659,706 | A * | 5/1972 | Serrell | 206/539 |
| 3,738,480 | A | 6/1973 | Chesley | |
| 3,844,408 | A | 10/1974 | Relyea | |
| 4,039,080 | A | 8/1977 | Cappuccilli | |
| 4,473,156 | A | 9/1984 | Martin | |
| 4,542,930 | A * | 9/1985 | Adams | 220/23.4 |
| 4,553,670 | A | 11/1985 | Collens | |
| 4,669,613 | A | 6/1987 | Collens | |
| 4,693,371 | A | 9/1987 | Malpass | |
| 4,749,085 | A | 6/1988 | Denney | |
| 4,785,932 | A | 11/1988 | Checke | |
| 4,799,590 | A * | 1/1989 | Furman | 206/539 |
| 4,890,741 | A * | 1/1990 | Edelstein | 206/538 |
| 4,895,257 | A * | 1/1990 | Winslow | 206/534 |
| 4,905,388 | A | 3/1990 | Sinkow | |
| 5,129,527 | A * | 7/1992 | Lataix | 206/539 |
| 5,372,258 | A | 12/1994 | Daneshvar | |
| 5,437,371 | A * | 8/1995 | Lataix | 206/539 |
| 5,549,204 | A * | 8/1996 | Toren | 206/539 |
| 5,624,036 | A * | 4/1997 | Roulin et al. | 206/534 |
| 6,082,544 | A * | 7/2000 | Romick | 206/531 |
| 6,550,618 | B2 | 4/2003 | Peterson | |
| 6,575,297 | B2 | 6/2003 | Schutten | |

* cited by examiner

*Primary Examiner*—Bryon P. Gehman

(57) ABSTRACT

A medication regimen communication device for holding example medications within the cavities (2) of modular frames (100). Each frame displays one type of medication, and frames may be attachable to or detached from one another as needed. When attached, each cavity would align with one another and with an indicated time. An example dosage (14) is contained in the cavity appropriate to the timing of that dosage. When fully employed, the connected frames and their contents would consist of a representation of all the medications taken over the period of indicated time—typically a single day's medications.

9 Claims, 2 Drawing Sheets

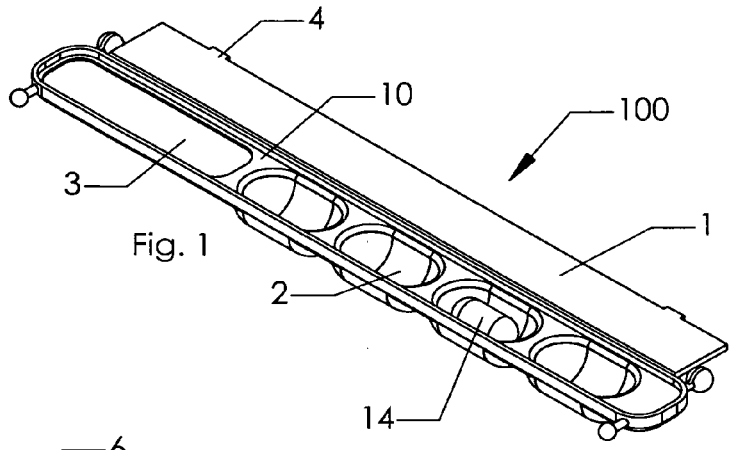
Fig. 1
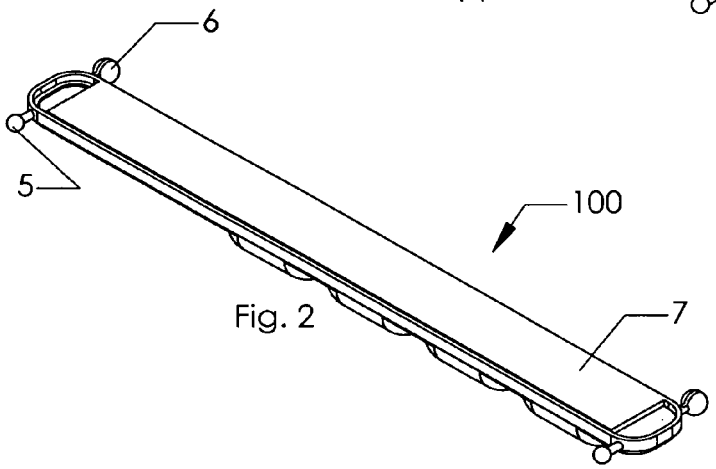
Fig. 2
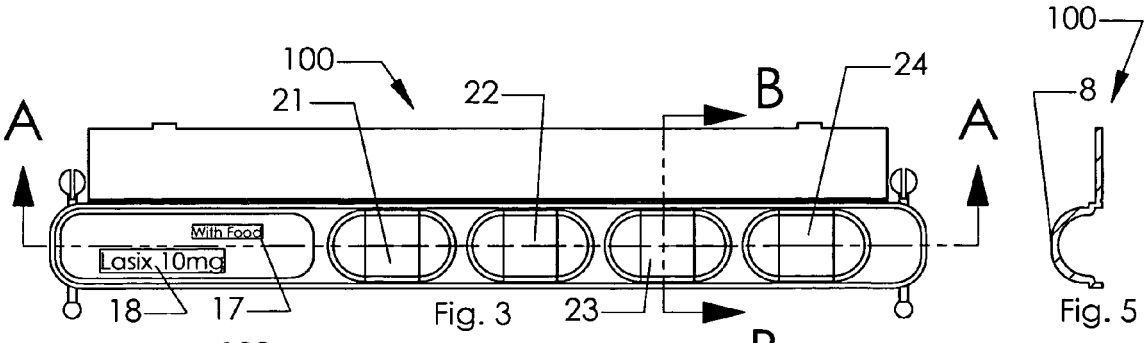
Fig. 3
Fig. 5
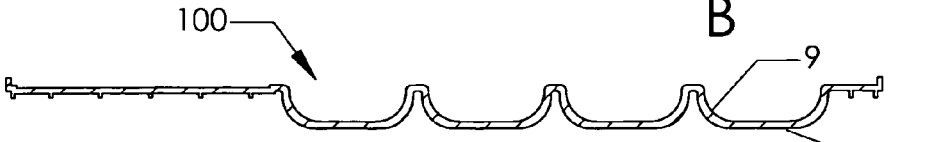
Fig. 4

MEDICATION DOSAGE REGIMEN COMMUNICATION DEVICE

BACKGROUND OF THE INVENTION

1. Field of Invention

This invention relates to medication containers, specifically to such containers that are arranged as calendars for the aid in consumption of the medications.

2. Description of Prior Art

This invention relates to a system and apparatus for the containing and communicating of medication regimens, particularly ones that are complex and/or frequently changing. Because polypharmacy (use of many medicines, drugs (including herbal or "over the counter") in the treatment of disease) is usually associated with serious disease or with multiple concurrent diseases or maladies it typically involves more persons in the management of the patient's health. The patient himself (or herself, for that matter) is the typical primary user and compiler of that information and he may need an aid to managing and communicating that information to all his other healthcare providers and assistants (some examples: physicians, pharmacists, nurses, homecare nurses, relatives, friends). Depending on the individual patient, the regimen of polypharmacy may include from two to over one hundred medicines and supplements. The number and type of medications may change frequently and can be confusing, especially when the change is in name only (from branded to generic) or when the patient's health is stable but their provider's formulary changes. Communicating the regimen succinctly, plainly, and accurately can be a cumbersome task considering the commonly short duration of a consultation. Whatever device a patient employs, it must be portable and durable enough to make many trips to his providers.

There have been many attempts at providing an aid to these persons but these attempts have missed solutions to the key needs of patients with polypharmacy in their inventions. Additionally, these inventions do not address many of the communication needs of low-literacy, illiterate, mentally handicapped, or dyslexic users.

Both U.S. Pat. No. 4,693,371 to Malpass (1987) and U.S. Pat. No. 1,583,419 to Cappuccilli (1977) show pill trays for organizing and dispensing containers for medication regimens which are arranged to show solid medications to be consumed at set times during the day. Both are designed to be rigid and secure, non-collapsible box structures to hold medications for the later consumption of those medications. Both rely on 3 things to understand the regimen: the physical layout of the cavities in rows and columns, printed information at the indices of those rows and columns to be read by the user as to the significance of that row or column, Malpass has added to this pill-grid box another adjacent container to hold an exemplification of the appropriate dosage of medication to be taken. It is designed in such a way that this example dosage portion of the device is not to be accessed by the user, but set out by a pharmacist or other person and will be difficult to open so as to only allow the healthcare provider to access it.

In one embodiment of the container, a series of cassettes exist so that the medications may be pooled together and filled so that it might be removed and transported by the user. When used in combination with the main tray it serves to reduce the possibility of wrong dosage, however when used alone it is little more than a compartmentalized container with multiple medications arranged by preferred medication time.

Another U.S. Pat. No. 1,844,189 to Stuart (1928) shows other methods of displaying medicines whereby the medication itself is prominently displayed in the same container as a reservoir of the same medication.

U.S. Pat. No. 1,717,060 to Mottayaw (1926) describes a tray for charting the timing of medication administration that may be examined by a doctor to see if his directions are being followed, but incorporates nothing for the written communication as to the identity of each medication. It also makes no provision for easily understanding the total daily intake of medications.

U.S. Pat. No. 6,575,297 to Schutten (2003) describes a set of pockets for medications and significant space for writing copious information about the medications, though because it has only one example medication both the patient and any doctors must still make an interpretation of the written data thereon as to the scheduling of the regimen. In addition, because only one example pill is included, there is no "safety margin" for a full one-day supply of those medications taken more than once a day.

U.S. Pat. No. 6,550,618 to Peterson (2003) is of a constant size and cannot expand or contract with each medication gained or lost in the patient's regimen. This limitation can be significant when the regimen is much smaller or larger in comparison to the size of the purchased grid. It also requires an add-on card to explain the contents of the apparatus, which may be lost and render the entire set of medications unusable with a subsequent change in the regimen.

U.S. Pat. No. 5,372,258 to Daneshvar (1994) also envisions a maximum regimen size as it is not readily expandable. It envisions one example pill or medication and written information about the timing of consumption of the medication, such that the written information is critical to the user's understanding of that timing. It also does not easily allow the user to, for example, take only the medications necessary with him to the pharmacist when refilling prescriptions. If the user desired to only take the prescriptions to be refilled, he would have to partially empty the container and rearrange it on his return.

Finally, U.S. Pat. No. 3,003,273 to Tapper (1961) describes some methods for packaging small quantities of products like tablets with a label area large enough to include whatever written information is required by law to accompany the product.

Insofar as I am aware, there has not thus far been developed a device or method which makes easy and convenient the communication of a complex medication regimen between healthcare providers and patients that conveniently accommodates large, changing regimens and users with difficulty understanding written medical information.

OBJECTS AND ADVANTAGES

The improved medication regimen communication device is comprised of a single necessary part with one or more optional parts which extend the functionality of the device in a modular way. The basic part or module is a device for holding an individual type of medication or drug which has as a preferred embodiment four cavities corresponding to four times each day that may hold example unit dosages for that medication. The cavities may be sized to contain only a unit dosage and not for bulk storage of the medication, thus making the device significantly more compact than other similar devices.

The frame has a positive-closure top that is transparent so that the medication may be seen by the patient, physician, or any other interested person. The frame also has an area where information relevant to the administration of the medication (some examples: medication name, generic name, dosage, medication strength, purpose of medication, precautions for administration with foods or drink) may be indicated in words, iconographs, or other indications on an affixed or free label of paper or other suitable material. Additionally, there is an area on which an easily identifiable and unique iconograph or visual pattern is placed so that a user might be able to identify that container without having to read any of the information thereon. This area might also have machine-encoded information (example: 1 dimensional or 2 dimensional barcodes or a radio-frequency chip or other information embedding technology).

The preferred embodiment of the frame would also include a feature or mechanism that would allow individual frames to be attached to one another in such a way that they might be folded or rolled up as to protect and conceal the frames from general view as well as reducing their size in one or more dimensions. If the container were to be created by a plastic injection molding process this could be accomplished with a articulating ball-and-socket type joint, pin hinge, or other connector that anyone skilled in the art might identify. Additionally, or in lieu of such a molded-in feature, the containers could be arranged in a sewn fabric organizer that would also allow this rolling or collapsing action.

The preferred embodiment of the frame would have a flat bottom to make a more stable base when filling or otherwise manipulating the container. When connected together, the cavities in the frame would align in vertical columns that would correspond to indicia at the head of (or anywhere within) the set of frames that would generally correspond to various times of the day or week. These times would indicate the appropriate timing intervals to take the medications in each columns' cavities.

Additionally, the design would allow the attached frames to be made roughly planar and set upon a photocopier or scanner and have the arranged regimen reproduced for archival purposes, or to be sent to a healthcare provider.

Some additional components would serve to extend the functionality of the device: Labels with an easily identifiable and unique iconograph or visual pattern corresponding to the iconograph or pattern on the container could be placed on the prescription bottle or container for easy identification and correlation between the containers. This would be particularly useful for low-literacy, illiterate, mentally handicapped, or dyslexic users. Another additional component may be an insert of a suitable material with icons or other indications of daily or weekly frequency of administration different from the main column indicia. The insert might also have a number of icons or other indications of administration corresponding to the main column indicia which might be used for medications that are not suitable for storage in the aforementioned frame such as liquid, injectible, refrigerated, or otherwise unsuitable medications. The insert might also have a set of icons or other indications as to the nature of the unsuitability of the medication to be housed in the container so that this information might be plain and visible to any person.

The device when fully assembled would be compact and suitable for transportation to any appointments a patient might have because it has no cavities for bulk storage of medications. This deletion of any bulk storage performance from the device is a significant advantage as well in terms of easy communication to healthcare providers and comprehension of the regimen by healthcare providers.

Although the above description contains many specificities, they should not limit the scope of the invention. The descriptions are to provide some illustrations of preferred embodiments of the invention. For example, some regimens would be better served with 7 cavities—one for each day of the week—and some regimens with 3 cavities—with 3 daily meals—while others with some other number. Some embodiments would have one removable cover, others a hinged cover over each cavity, and yet others with a slidable cover.

Thus the scope of the invention should be determined by the appended claims instead of the examples above.

SUMMARY

In accordance with the present invention a modular medication container able to accommodate variously sized regimens by attaching component frames to one another—one frame for each medication type. These frames having cavities in which to hold an example dosage of the frame's medication type in each cavity for the time of the day or week when that dosage should be taken. The time for taking the dosage is indicated on an attached legend.

DRAWINGS

FIG. 1 is a perspective view of a preferred embodiment of the frame with an integral cover open;

FIG. 2 is a perspective view of a preferred embodiment of the frame with the cover fitted to contain items therein;

FIG. 3 is a top plan view of a preferred embodiment of the frame with an integral lid open;

FIG. 4 is a cross-section view along line A-A of FIG. 3;

FIG. 5 is a cross-section view along line B-B of FIG. 3;

DETAILED DESCRIPTION

Figure 6:
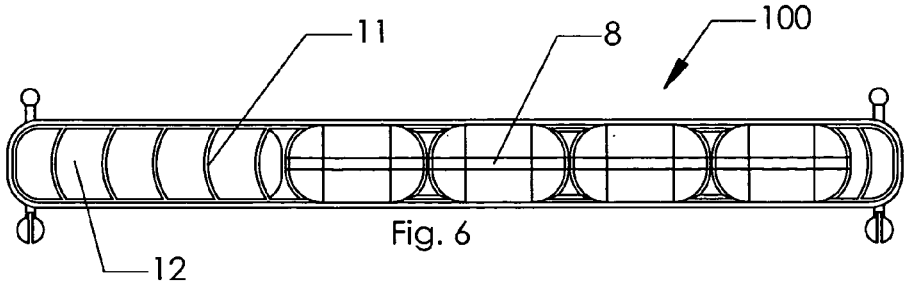
FIG. 6 is a bottom view of a preferred embodiment of the frame in closed form.

FIG. 1 is a perspective view of a preferred embodiment of the generally linear frame 100 with an integral cover 1 open. In FIG. 1, the preferably transparent frame is arranged in generally linear fashion at least two cavities 2 into which may be placed the appropriate unit dosage of the medication the details of which to be indicated on the surface 3. This surface 3 and/or 10 is an area where an easily identifiable visual pattern or iconograph that is unique to the frame may be affixed, attached, placed, or molded in. This surface 3 and/or 10 may contain indicia to vary the intended timing of consumption for the frame's contents so that an observer might know they are intended to be taken before or after the other dosages in similarly vertically aligned cavities. A preferably transparent cover 1 when closed will prevent contents from coming out. Positive closure can be assured by tabs 4. An example dosage of a capsule shaped medication 14 is shown in the third cavity from the information area 3.

FIG. 2 is a perspective view of a preferred embodiment of the container with the cover 1 closed to contain items therein. The cover having an outside surface 7 may be marked upon with the timing indicia which correspond to vertically aligned cavities 2. Ball 5 and socket 6 members allow the containers to be selectively attachable in such a way as to allow them to fold and collapse to save space. These members also align connected frames so that the plurality of cavities 2 fall into an linear arrangement with the indicia 13.

FIG. 3 is a top plan view of a preferred embodiment of the frame with the integral lid open showing four cavities for medications. The first cavity 21 for a unit dosage corresponding to preferred timing of the first of adjacent vertical indicia 13. This preferred embodiment also having second cavity 22, third cavity 23, and fourth cavity 24. Indicia 17 in the non-cavity area shows information modifying the timing indicia for the vertically aligned indicia. Indicia 18 shows basic information about the medication contained in the frame.

FIG. 4 is a cross-section view of the container showing the flat bottom 8 for better stability when filling or evacuating the container and a curved internal wall 9 for ease of dosage extraction and cavity cleaning.

FIG. 5 is a cross-section view along line B-B of FIG. 4 showing clearly the stabilizing flat bottom 8.

FIG. 6 is a bottom view of a preferred embodiment of the container in closed form showing structural ribs 11 for stiffening of the container when. There exists at least one surface 12 underneath area 3 that may be used as an area to also indicate information related to the proper administration of the medication either by manual or computer generated and/or encoded methods such as handwriting, printing, barcoding, or any other appropriate means.

Figure 7:
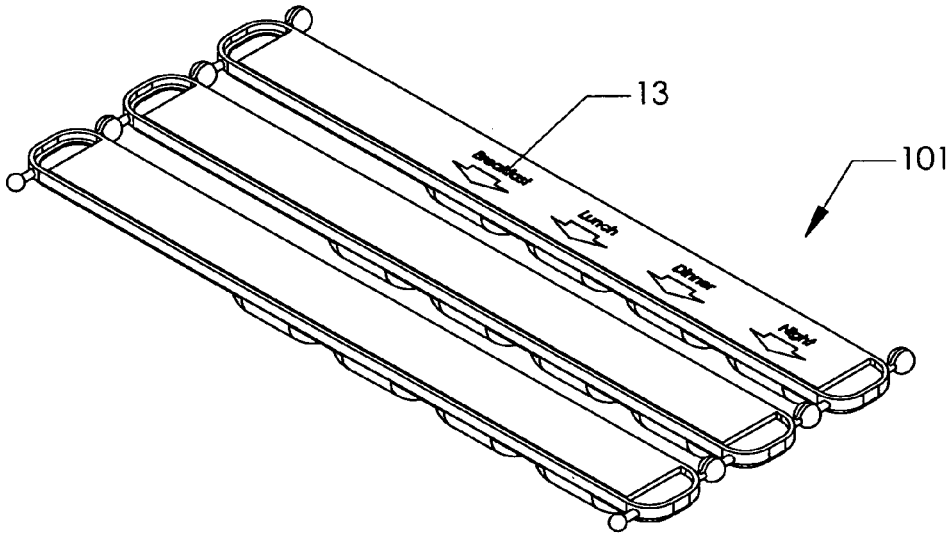
FIG. 7 is a perspective view showing a plurality of a preferred embodiment of the frame attached to one another, unfolded and laying flat.

FIG. 7 is a perspective view showing a plurality 101 of the preferred embodiment of the frame selectively attached together, unfolded and laying flat. At the top 13 of each vertical arrangement of cavities there is provided indicia relating to the timing any medications in that vertical arrangement should be taken.

Figure 8:
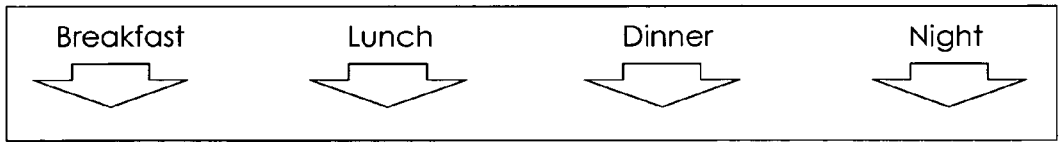
FIG. 8 is a top view of preferred columnar indicia.

FIG. 8 is an example of a preferred embodiment of the vertically aligned indicia showing typical times of the day in which medicines are consumed. Other embodiments may substitute iconographs or indicia in the user's preferred language.

Figure 9:
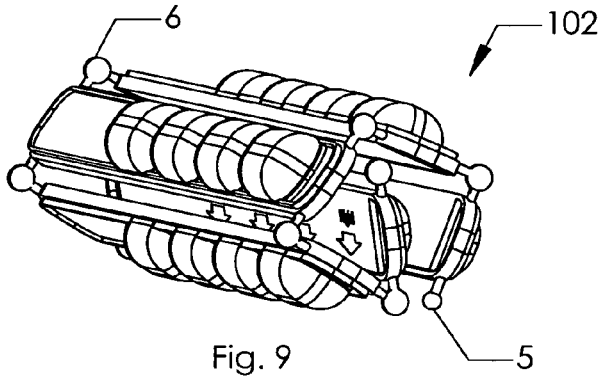
FIG. 9 is a perspective view of an assembly of 5 embodiments illustrating a plurality of a preferred embodiment in a compact arrangement.

FIG. 9 is a perspective view showing a plurality 102 of another preferred embodiment connected together and positioned in a compact manner, more suitable for carrying in a bag or purse. Surface 16 underneath area 3 is another embodiment of are for information about the frame's contents.

I claim:

1. A device for holding and displaying select unit dosages of a therapeutic regimen for a user, said device comprising:

(a) a first three-dimensional generally rectilinear frame having at least two cavities, each of at least two cavities being sized and shaped to accommodate a single first unit dosage of common first medication of the regimen, so that said first frame contains common first dosages;

(b) a second three-dimensional generally rectilinear frame having at least two cavities, each of at least two cavities being sized and shaped to accommodate a single second unit dosage of common second medication of the regimen, so that said second frame contains common second dosages;

(c) wherein said first frame being selectively attachable to said second frame so that said at least two cavities of said first frame align vertically with corresponding said at least two cavities of said second frame;

(d) appropriate timing indicia located adjacent said vertically aligned cavities to indicate to user when to take said first and second dosages from said aligned cavities of said respective first and second frames;

(e) indicia relevant to the identity of the common dosages of the regimen on each frame whereby persons unfamiliar with the contents each of said frame may quickly read at least one aspect of the contents; and (f) wherein said first frame is attached to said second frame by an articulatable and selectively attachable component whereby said first and second frames may be rolled up for ease of transport.

2. The device as in claim 1, wherein at least one of said first and second frames has an area for graphic information whereby a person may visually identify without employing the faculty of language the contents of the at least one frame as being identical to the contents of another container in which the dosages may be stored in bulk.

3. The device as in claim 1, wherein at least one of said first and second frames is comprised of a transparent material whereby an observer may be allowed clear view of its dosages.

4. The device as in claim 1, wherein at least one of said first and second frames having indicia to vary the timing of the dosage from timing indicia located adjacent vertically aligned cavities whereby an observer may clearly see the preferential order in which dosages in vertically aligned cavities should be taken.

5. The device as in claim 1, wherein at least one of said first and second frames is further comprised of an integral hinged cover sized and shaped to enclose at least one of said cavities attached to at least one edge.

6. The device as in claim 1, wherein said first frame is attached to second frame with an articulatable and selectively attachable component being a ball-and-socket linkage.

7. The device as in claim 1, wherein at least one of said first and second frames is further comprised of an integral hinged transparent cover, sized and shaped to enclose at least one of said cavities attached to at least one edge.

8. A device for holding and displaying select unit dosages of a therapeutic regimen for a user, said device comprising:

(a) a first three-dimensional generally rectilinear frame having at least two cavities, each of said at least two cavities accomodating a single dosage of first medication of the regimen, so that said first frame contains common dosages of first medication;

(b) a second three-dimensional generally rectilinear frame having at least two cavities, each of at least two cavities accomodating a single dosage of second medication of the regimen, so that said second frame contains common dosages of second medication;

(c) wherein said first frame being selectively attachable to said second frame so that said at least two cavities of said first frame align perpendicularly with corresponding said at least two cavities of said second frame;

(d) appropriate timing indicia located adjacent perpendicularly aligned cavities to indicate to user when to take said first and second dosages from said aligned cavities of said respective first and second frames;

(e) wherein said first and second frames further comprising indicia relevant to the identity of the said first and second medications of the regimen;

(f) wherein said first and second frames each further comprise a cover, sized and shaped to enclose at least one of said cavities; and (g) wherein said first frame is attached to said second frame with an articulatable and selectively attachable ball-and-socket linkage.

9. A device for holding and displaying select unit dosages of a therapeutic regimen for a user, said device comprising:

(a) a first three-dimensional generally rectilinear frame having at least two cavities, each of at least two cavities accommodating a single first unit dosage of common first medication of the regimen, so that said first frame contains common first dosages;

(b) a second three-dimensional generally rectilinear frame having at least two cavities, each of at least two cavities accommodating a single second unit dosage of common second medication of the regimen, so that said second frame contains common second dosages;

(c) wherein said first frame being selectively attachable to second frame so that said at least two cavities of said first frame align vertically with corresponding said at least two cavities of said second frame;

(d) wherein said first frame is attached to said second frame by an articulatable and selectively attachable component whereby said first and second frames may be rolled up for ease of transport;

(e) appropriate timing indicia located adjacent said vertically aligned cavities to indicate to the user when to take said first and second dosages from said aligned cavities of said respective first and second frames;

(f) wherein at least one of said first and second frames having indicia to vary the timing of the dosage from timing indicia located adjacent vertically aligned cavities whereby an observer may clearly see the preferential order in which dosages in vertically aligned cavities should be taken;

(g) indicia relevant to the identity of the common dosages of the regimen on each frame whereby persons unfamiliar with the contents of said each frame may quickly read at least one aspect of the contents;

(h) wherein at least one of said first and second frames has an area of graphic information whereby a person may visually identify without employing the faculty of language the contents of the at least one frame as being identical to the contents of another container in which the dosages may be stored in bulk;

(i) wherein at least one of said first and second frames is further comprised of an integral hinged cover sized and shaped to enclose at least one of said cavities attached to at least one edge; and (j) wherein at least one of said first and second frames and integral hinged cover is of a transparent material whereby an observer may be allowed clear view of its dosages.

* * * * *